US010831141B2

(12) United States Patent
Maeno

(10) Patent No.: US 10,831,141 B2
(45) Date of Patent: Nov. 10, 2020

(54) IMAGE FORMING APPARATUS

(71) Applicant: CANON KABUSHIKI KAISHA, Tokyo (JP)

(72) Inventor: Masaki Maeno, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/749,145

(22) Filed: Jan. 22, 2020

(65) Prior Publication Data

US 2020/0241458 A1 Jul. 30, 2020

(30) Foreign Application Priority Data

Jan. 28, 2019 (JP) ..... 2019-012066

(51) Int. Cl.
*G03G 15/00* (2006.01)
*G03G 15/16* (2006.01)

(52) U.S. Cl.
CPC ..... *G03G 15/5054* (2013.01); *G03G 15/1615* (2013.01)

(58) Field of Classification Search
CPC ..... G03G 15/5054; G03G 15/1615
See application file for complete search history.

(56) References Cited

U.S. PATENT DOCUMENTS 6,198,897 B1 * 3/2001 Ream ..... G03G 15/1615 399/121
6,661,981 B2 * 12/2003 Boothe ..... G03G 15/1605 399/301
6,836,635 B2 * 12/2004 Metzler ..... G03G 15/1605 399/301
7,671,877 B2 * 3/2010 Fitzpatrick ..... H04N 1/506 347/116
7,812,735 B2 * 10/2010 Kahl ..... G03G 15/167 340/673
7,920,814 B2 * 4/2011 Atwood ..... G03G 15/0131 399/302
8,086,156 B2 * 12/2011 Tao ..... G03G 15/5058 198/806
8,139,968 B2 * 3/2012 Katoh ..... G03G 15/0131 399/154
8,326,162 B2 * 12/2012 DeJong ..... G03G 15/1615 399/302
9,014,602 B2 * 4/2015 Sueoka ..... G03G 15/1605 399/302
9,207,252 B2 12/2015 Hamada et al.
(Continued)

FOREIGN PATENT DOCUMENTS

JP 2001-215857 A 8/2001

*Primary Examiner* — G. M. A Hyder
(74) *Attorney, Agent, or Firm* — Venable LLP

(57) ABSTRACT

Provided is an image forming apparatus capable of forming a desired image with high accuracy. The image forming apparatus includes: an endless belt configured to convey a sheet; a conveying roller configured to convey the endless belt while being driven by a drive source; a first sensor configured to detect a specific position on the endless belt; a second detecting sensor configured to detect the specific position on the endless belt; a tension roller, which is provided between those sensors, and is configured to support the endless belt in a tensioned state while applying a tensile force to the endless belt; and a control unit.

11 Claims, 5 Drawing Sheets

(56) References Cited

U.S. PATENT DOCUMENTS

| | | | | |
|---|---|---|---|---|
| 2006/0024104 | A1* | 2/2006 | Castelli | G03G 15/0163 399/372 |
| 2012/0008986 | A1* | 1/2012 | Kaji | G03G 15/5033 399/167 |
| 2012/0328337 | A1* | 12/2012 | Hiratsuka | G03G 15/1615 399/302 |

* cited by examiner

IMAGE FORMING APPARATUS

BACKGROUND OF THE INVENTION

Field of the Invention

The present disclosure relates to an image forming apparatus configured to form an image on a sheet conveyed by an endless belt.

Description of the Related Art

For a laser printer, a digital copying machine, and other such image forming apparatus that employ an electrophotographic method, there are proposed various configurations for transferring a toner image formed on an image bearing member onto an intermediate transfer member and then transferring the toner image from the intermediate transfer member onto a sheet.

In such an image forming apparatus, components of an intermediate transfer unit are thermally expanded due to the influence of an environmental temperature. The components of the intermediate transfer unit include: an intermediate transfer member; a drive roller, support rollers, and a tension roller for the intermediate transfer member; and a frame configured to support those different kinds of rollers. As a result of the thermal expansion, the conveying speed of an intermediate transfer belt or another such intermediate transfer member varies, and when the toner image is transferred onto the sheet, its transfer position varies, which raises a fear that it may become difficult to form a desired image.

In U.S. Pat. No. 9,207,252 B2, there is disclosed a technology for stabilizing the speed of an intermediate transfer belt by reading a mark on the intermediate transfer belt through use of a first sensor and a second sensor to identify a time at which each of the first sensor and the second sensor detects the same mark. With such a configuration, the same mark can be reliably identified even when the detected mark has a stain, and hence the speed of the intermediate transfer belt can be measured with accuracy.

Meanwhile, in Japanese Patent Application Laid-Open No. 2001-215857, there is disclosed a technology for stabilizing the circumferential length of an intermediate transfer belt by detecting a mark provided on the intermediate transfer belt through use of a mark sensor to obtain a change amount of the circumferential length of the intermediate transfer belt from the time interval of a mark detection signal. By changing a time to start to feed a sheet depending on the obtained amount of change in belt length, even when a change occurs in the circumferential length, it is possible to convey the sheet at a timing suitable for both the leading edge of an image on the intermediate transfer member and the leading edge of the sheet.

However, when an intermediate transfer belt is used to convey a sheet, there may simultaneously occur a change in conveying speed of the intermediate transfer belt due to the expansion of a drive roller, and a change in circumferential length of the intermediate transfer belt due to the expansion of the intermediate transfer belt itself In each of the technology described in U.S. Pat. No. 9,207,252 B2 and the technology described in Japanese Patent Application Laid-Open No. 2001-215857, one of the changes in conveying speed and the change in circumferential length is individually measured to solve the problem on the assumption that the other one is substantially constant. It is possible to separately measure the change in conveying speed and the change in circumferential length, but in this case, it is required to separately provide measurement mechanisms therefor, which leads to an increase in cost. In addition, the change in conveying speed and the change in circumferential length exert an influence on each other. When those changes are individually measured to predict a position at which the toner image is to be transferred from the intermediate transfer member onto the sheet, the mutual influences cannot be reflected in the prediction, thereby raising a fear that sufficient prediction accuracy may not be obtained.

SUMMARY OF THE INVENTION

An image forming apparatus, according to the present disclosure includes: an intermediate transfer unit including: an endless belt configured to convey a sheet on which an image is to be formed; a conveying roller configured to convey the endless belt while being driven by a drive source; a first detecting unit configured to detect a specific position on the endless belt; a second detecting unit configured to detect the specific position on the endless belt; a tension roller, which is provided between the first detecting unit and the second detecting unit, and is configured to support the endless belt in a tensioned state while applying a tensile force to the endless belt; and a control unit, wherein the control unit is configured to: obtain a first measurement time and a second measurement time, the first measurement time representing, based on detection results obtained by the first detecting unit and the second detecting unit, a time period elapsed after the specific position is detected by the second detecting unit until the specific position is detected by the first detecting unit without passing through the tension roller, and the second measurement time representing a time period elapsed after the specific position is detected by the first detecting unit and passes through the tension roller until the specific position is detected by the second detecting unit; obtain a conveying speed of the endless belt based on the first measurement time; obtain a change in belt length of the endless belt due to the tensile force of the tension roller, based on the second measurement time; and perform image formation based on the obtained conveying speed and the obtained change in belt length.

Further features of the present invention will become apparent from the following description of exemplary embodiments (with reference to the attached drawings).

DESCRIPTION OF THE EMBODIMENTS

Now, at least one embodiment of the present disclosure is described in detail with reference to the accompanying drawings.

Image Forming Apparatus

Figure 1:
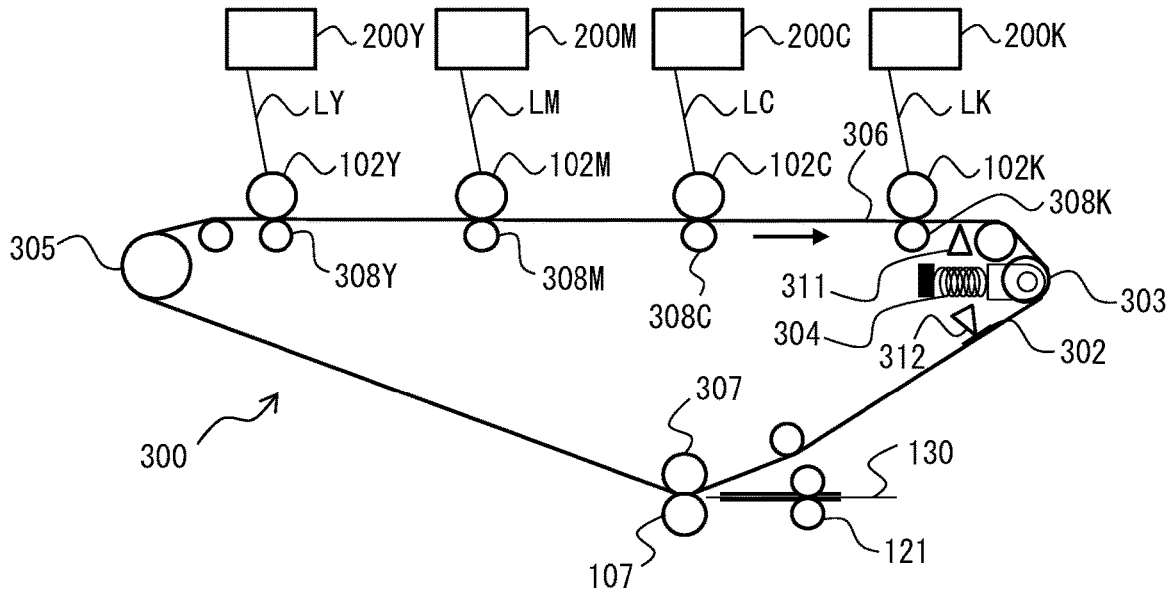
FIG. 1 is a schematic cross-sectional view of an image forming unit of an image forming apparatus according to at least one embodiment of the present disclosure.

FIG. 1 is a schematic cross-sectional view of an image forming unit configured to perform image formation and image transfer, which is included in an image forming apparatus according to at least one embodiment. The illustrated image forming unit includes light scanning devices 200Y, 200M, 200C, and 200K, photosensitive drums 102Y, 102M, 102C, and 102K, and primary transfer rollers 308Y, 308M, 308C, and 308K. The suffixes Y, M, C, and K represent the colors of yellow, magenta, cyan, and black, respectively, and are omitted unless particular distinction is required.

The photosensitive drums 102Y, 102M, 102C, and 102K are arranged at different positions in the horizontal direction. The same applies to the primary transfer rollers 308Y, 308M, 308C, and 308K corresponding to the photosensitive drums 102Y, 102M, 102C, and 102K, respectively.

Images of the respective colors are each formed by the light scanning device 200, the photosensitive drum 102, and the primary transfer roller 308. In the image forming unit in at least one embodiment, the images of the respective colors are formed in the same manner, and hence the following description is directed to those different kinds of components for black (K) on behalf of the different kinds of components each provided for the respective colors, and descriptions of the components for the other colors are omitted.

The image forming unit includes an intermediate transfer unit 300. The intermediate transfer unit 300 includes an intermediate transfer belt 306 supported by a plurality of rollers in a tensioned state. The plurality of rollers include a drive roller 305 configured to drive the intermediate transfer belt 306, a tension roller 303 configured to pressurize the intermediate transfer belt 306 by an elastic member 304 to apply tension thereto, and a secondary transfer inner roller 307. The drive roller 305 is driven by a motor 401 serving as a drive source. The drive roller 305 is also provided with an encoder 402. The secondary transfer inner roller 307 forms a nip between the secondary transfer inner roller 307 and the transfer roller 107 opposed thereto, and transfers a toner image by pressure and electrostatic force onto a sheet 130 conveyed from a medium conveying unit.

A belt mark 302 for allowing recognition of a specific position on the intermediate transfer belt 306 is provided on the back surface (inner peripheral surface) of the intermediate transfer belt 306. Meanwhile, in the intermediate transfer unit 300, a first sensor 311 and a second sensor 312 each configured to detect the belt mark 302 passing therethrough are arranged at such positions as to face the belt mark 302. The first sensor 311, the tension roller 303, and the second sensor 312 are arranged along a conveyance path of the intermediate transfer belt 306 in the direction indicated by the arrow of FIG. 1 in the stated order.

Figure 2:
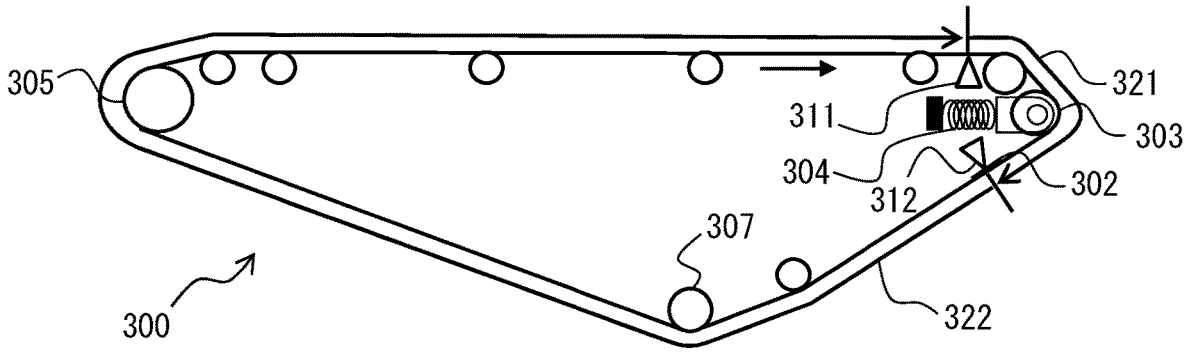
FIG. 2 is an explanatory view of a distance between a first sensor and a second sensor.

FIG. 2 is an explanatory diagram of a distance between the first sensor and the second sensor. When the drive roller 305 is eccentric, a belt conveying speed varies. In order to suppress the variation, the length of a conveyance path 321 extending from the first sensor 311 illustrated in FIG. 2 to the second sensor 312 through the tension roller 303 is set to an integral multiple of the circumferential length of the drive roller 305. The length of a conveyance path 322 from the second sensor 312 to the first sensor 311 through the secondary transfer inner roller 307, the drive roller 305, and other rollers instead of passing through the tension roller 303 is also set to an integral multiple of the circumferential length of the drive roller 305. The length of the conveyance path changes depending on the expansion of the drive roller 305 and the expansion of the intermediate transfer belt 306, but design values measured at a factory are used as dimensions to be used when the lengths of the conveyance paths 321 and 322 are set to the integral multiples of the circumferential length of the drive roller 305.

In order to reduce a detection error, it is preferred to set the length of the conveyance path 321 as short as possible, that is, it is optimal to match the length of the conveyance path 321 with the circumferential length of the drive roller 305. Meanwhile, it is preferred to set the length of the conveyance path 322 as long as possible. When the circumferential length of the intermediate transfer belt 306 is N times as long as the circumferential length of the drive roller 305, it is preferred to set the length of the conveyance path 322 N−1 times as long as the circumferential length of the drive roller 305. As a result, the conveyance path 322 is longer than the conveyance path 321. The sheet 130 is conveyed through a conveying roller 121 from a sheet feeding tray (not shown) to the intermediate transfer unit 300.

Next, procedures for the image formation and the image transfer are described. The light scanning device 200K emits a light beam (laser light) LK for exposing the photosensitive drum 102K charged by a charging device with light. An electrostatic latent image is formed on the photosensitive drum 102K when the photosensitive drum 102K is exposed with the light beam, and the electrostatic latent image formed on the photosensitive drum 102K is developed with a toner K by a developing unit (not shown). A toner image formed on the photosensitive drum 102K is transferred onto the intermediate transfer belt 306 by the primary transfer roller 308K in a primary transfer portion. For each of the other colors of C, M, and Y, an electrostatic latent image is developed and transferred onto the intermediate transfer belt 306 in the same manner. A nip portion formed between the photosensitive drum 102K and the intermediate transfer belt 306 when the primary transfer roller 308K presses the intermediate transfer belt 306 against the photosensitive drum 102K corresponds to the primary transfer portion (primary transfer position).

In this manner, the toner images corresponding to the respective color components are sequentially transferred onto the intermediate transfer belt 306 so as to be superimposed on each other, to thereby form a full-color toner image on the intermediate transfer belt 306. The toner image transferred onto the intermediate transfer belt 306 is conveyed to a secondary transfer portion while the intermediate transfer belt 306 is rotated in the direction indicated by the arrow. At this time, the sheets 130 are fed one by one from the sheet feeding tray, and conveyed to the secondary transfer portion by the conveying roller 121. After the position of the sheet 130 and the timing of its feeding are adjusted by the conveying roller 121, the sheet 130 is supplied to the secondary transfer portion so as to be brought into contact with the toner image on the intermediate transfer belt 306. A nip portion formed between the intermediate transfer belt 306 and the transfer roller 107 when the secondary transfer inner roller 307 presses the intermediate transfer belt 306 against the transfer roller 107 corresponds to the secondary transfer portion (secondary transfer position).

When the toner image transferred onto the intermediate transfer belt 306 and the sheet 130 fed from the conveying roller 121 enter the secondary transfer portion, a transfer voltage is applied to the transfer roller 107, and the toner image on the intermediate transfer belt 306 is transferred onto the sheet 130. The sheet 130 onto which the toner image has been transferred in the secondary transfer portion is conveyed to a fixing device (not shown). The fixing device fixes the toner image to the sheet 130 by heating the sheet 130 being conveyed. After that, the sheet 130 to which the toner image has been fixed is delivered to a sheet delivery portion.

Control Block Diagram

Figure 3:
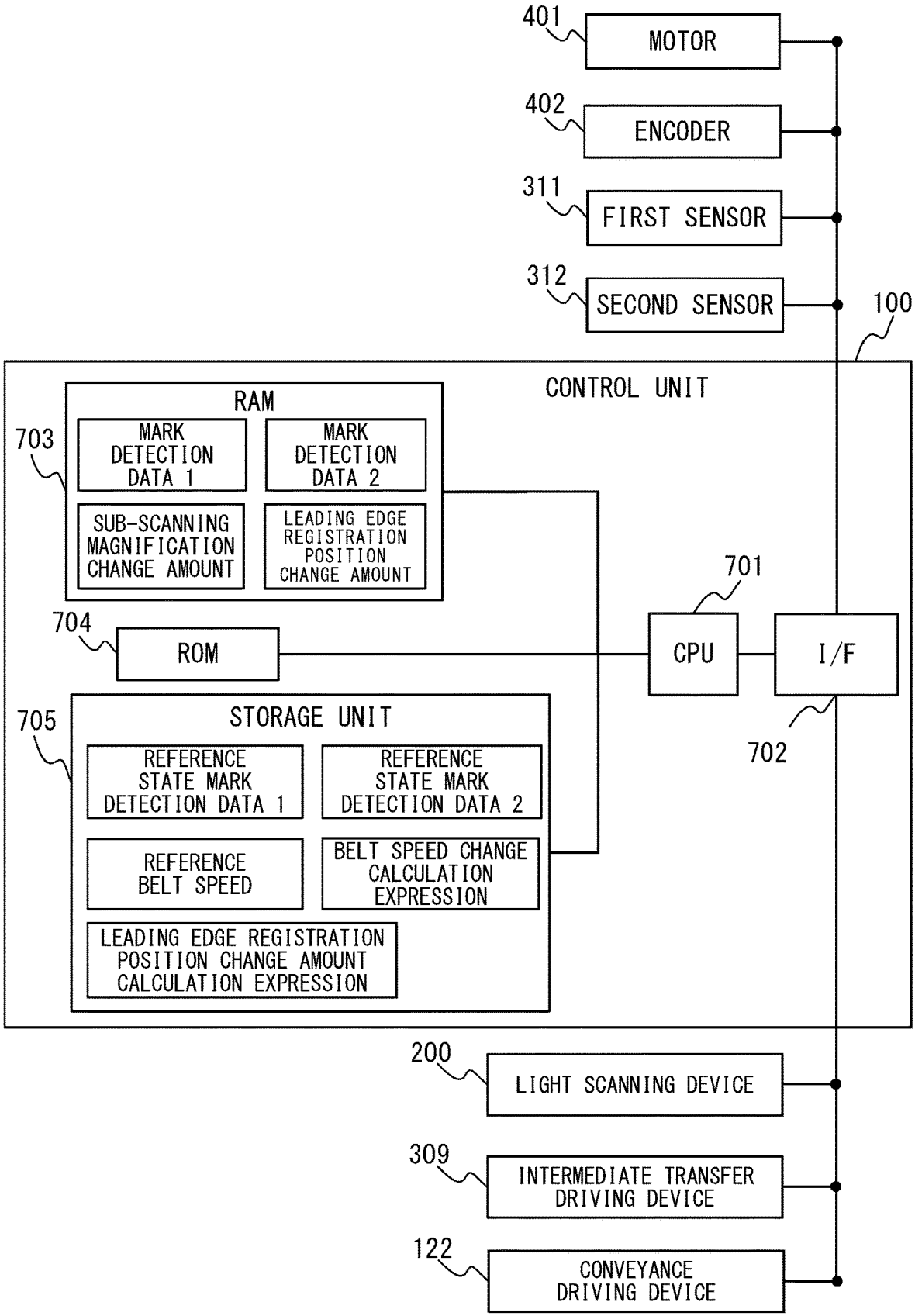
FIG. 3 is a functional block diagram of the image forming apparatus.

In FIG. 3, a functional block diagram of the image forming apparatus is illustrated. In FIG. 3, a control unit 100 includes a CPU 701 for arithmetic operation processing, an interface (I/F) 702, a RAM 703, a ROM 704, and a storage unit 705. The interface 702 sends signals input from the first sensor 311 and the second sensor 312 to the CPU 701, and sends control signals received from the CPU 701 to the light scanning device 200, an intermediate transfer driving device 309, and a conveyance driving device 122. The CPU 701 reads a computer program stored in the ROM 704, and uses the RAM 703 as a work area to execute the program, to thereby control the operation of an entire image forming system. The storage unit 705 is formed of, for example, a nonvolatile memory, and stores various programs to be executed by the CPU 701, parameters, and other such information.

The CPU 701 acquires input from each of the motor 401, the encoder 402, the first sensor 311, the second sensor 312, the light scanning device 200, and other such components, and stores the input in the RAM 703. In at least one embodiment, the CPU 701 stores, in the RAM 703, mark detection data 1 and mark detection data 2. It is noted that the mark detection data 1 is a data group of a belt passing timing at which the belt mark 302 is detected by the first sensor 311, and the mark detection data 2 is a data group of a belt passing timing at which the belt mark 302 is detected by the second sensor 312. The CPU 701 acquires the mark detection data 1 and the mark detection data 2 while rotating the motor 401 at a predetermined rotation speed based on an output value from the encoder 402. In addition, the CPU 701 stores, in the RAM 703, a sub-scanning magnification change amount and the change amount of the image formation position, which are calculated using calculation expressions described later based on the input acquired from the first sensor 311 and the second sensor 312. In at least one embodiment, a leading edge registration position being a position at which the leading edge of an image is formed on the sheet is used as the image formation position. The RAM 703 thus stores a leading edge registration position change amount.

Meanwhile, the storage unit 705 stores detection results obtained under a reference state for the first sensor 311 and the second sensor 312, and stores a reference belt conveying speed of the intermediate transfer driving device 309 for each operation mode of the image forming apparatus. In addition, the storage unit 705 stores each of the calculation expressions to be used by the CPU 701 to calculate the sub-scanning magnification change amount and calculate the leading edge registration position change amount.

The CPU 701 functions as a sub-scanning magnification change amount calculation unit configured to calculate the sub-scanning magnification change amount, and as a calculation unit configured to calculate the leading edge registration position change amount. The CPU 701 transmits the control signals to the light scanning device 200 and the conveyance driving device 122 based on the calculated sub-scanning magnification change amount and the calculated leading edge registration position change amount. The light scanning device 200 irradiates the photosensitive drum 102 with the laser light based on the received control signal, and the conveyance driving device 122 conveys the sheet 130 to the secondary transfer portion based on the received control signal.

Correction of Sub-Scanning Magnification and Leading Edge Registration Position

In at least one embodiment, a change in belt speed and a change in belt length are detected in the correction of the sub-scanning magnification and the leading edge registration position in the following manner. A temperature increase of the image forming apparatus causes changes mainly in two characteristic values of the sub-scanning magnification and the leading edge registration position among image-related characteristics of the intermediate transfer unit 300. This is because the belt conveying speed changes due to the expansion and the contraction of the drive roller 305, which accordingly causes changes in each of the sub-scanning magnification of the toner image on the belt, a writing position for each color, and a timing of arrival at the secondary transfer portion.

In addition, the belt length of an endless belt changes due to the expansion and the contraction of the intermediate transfer belt 306 itself. The tension roller 303 applies predetermined tension to the intermediate transfer belt 306, and its position moves depending on the expansion and the contraction of the belt length, and hence the tensile force of the intermediate transfer belt 306 is maintained at a constant level. However, the conveyance distance of the sheet 130 also changes as the position of the tension roller 303 changes due to the change in circumferential length. In at least one embodiment, the tension roller 303 is arranged between the primary transfer portion and the secondary transfer portion, and hence there occurs a change in conveyance distance of the sheet 130 from the primary transfer portion to the secondary transfer portion. As a result, there occurs a change in position of the leading edge of the image formed on the sheet 130.

In order to make the position of the leading edge of the image formed on the sheet 130 constant irrespective of the temperature of the image forming unit, it is required to detect and correct a change in circumferential length of the intermediate transfer belt 306 and a corresponding change in position of the tension roller 303. It is also required to detect and correct a change in belt conveying speed due to the expansion of the drive roller 305.

The CPU 701 of the control unit 100 obtains, as a time period T1, a time difference (first measurement time) between a time at which the belt mark 302 is detected by the second sensor 312 and a time at which the belt mark 302 is subsequently detected by the first sensor 311. The obtained time difference is used to obtain a change in belt conveying speed due to the expansion of the drive roller 305.

From the viewpoint of suppressing an error in the conveying speed, it is preferred to thus obtain the conveying speed through use of the time period T1 elapsed until the mark that has been conveyed along the conveyance path 322 extending from the second sensor 312 to the first sensor 311 is detected. This is because the influence of the expansion (extension) of the intermediate transfer belt can be ignored in the conveyance path 322. It is noted that, when the intermediate transfer belt expands (extends), the intermediate transfer belt is pulled by a tension roller, and hence the distance from the second sensor 312 to the first sensor 311 does not change. From this fact, in at least one embodiment of the present disclosure, the conveying speed changed by the expansion or the contraction of the drive roller 305 can be detected based on the time period during which the belt mark 302 has been conveyed along the conveyance path 322. In at least one embodiment of the present disclosure, a target rotation speed of the motor 401 for the drive roller 305 is controlled by the CPU 701 based on the time difference involved in the detection of the belt mark 302 (in the conveyance path 322). The CPU 701 also detects belt mark detection times and calculates a time difference therebetween in advance, and sets the calculated value as $T1_{base}$ as a reference value of T1. This state in which the calculation is performed in advance is to be used as the reference state in the subsequent calculation operations.

A result of the above-mentioned measurement of T1 performed at the timing of executing correction, for example, at the time of image formation, is set as $T1_{now}$. The CPU 701 uses $T1_{base}$ and $T1_{now}$ to calculate a sub-scanning magnification change amount $S_{offset}$ and a belt conveying speed change amount $V_{offset}$ by the calculation expression for a change in belt conveying speed. $S_{offset}$ represents an amount of change exhibited when the sub-scanning magnification corresponding to the case in which the value of T1 is $T1_{base}$ is set as a reference. Meanwhile, $V_{offset}$ represents an amount of change exhibited when a belt conveying speed $V_{base}$ of the endless belt corresponding to the case in which the value of T1 is $T1_{base}$ is set as a reference.

In at least one embodiment, $T1_{now}$, $T1_{base}$, and $V_{base}$, which are described above, and a coefficient k1 are used to obtain $V_{offset}$ by Expression 1.

$$V_{offset}=-V_{base}*k1*(T1_{now}-T1_{base})/(T1_{now}) \quad \text{(Expression 1)}$$

where k1 represents a correction coefficient for correcting a difference in thermal expansion coefficient between different materials, which is defined from thermal expansion coefficients exhibited by materials.

For example, when the material of the drive roller 305 is aluminum and a secondary transfer frame configured to support the first sensor 311 and the second sensor 312 is iron, k1 can be set as expressed by Expression 2.

$$K1=\alpha_\text{aluminum}/\alpha_\text{steel}=(23*10^{-6})/(12.1*10^{-6}) \quad \text{(Expression 2)}$$

However, the drive roller 305 has a base material made of aluminum and is provided with a rubber layer on its surface, and the secondary transfer frame has a base material made of iron with a resin material, which is used for a holding portion for a sensor. The actual value of k1 is different from the value obtained by the above-mentioned simple theoretical expression, and hence the value of k1 may be actually measured in advance and stored as a constant in, for example, the storage unit 705.

The CPU 701 obtains the sub-scanning magnification change amount $S_{offset}$, which is an amount of change in sub-scanning magnification exhibited during the image formation, from $V_{offset}$ and $V_{base}$ obtained in the above-mentioned manner. In at least one embodiment, the sub-scanning magnification change amount $S_{offset}$ is obtained by Expression 3.

$$S_{offset}=V_{offset}/V_{base}=-k1*(T1_{now}-T1_{base})/(T1_{now}) \quad \text{(Expression 3)}$$

Then, the CPU 701 obtains the leading edge registration position change amount due to the expansion of the intermediate transfer belt 306. For that purpose, the CPU 701 obtains, as T2, a time difference (second measurement time) between a time at which the belt mark 302 is detected by the first sensor 311 and a time at which the belt mark 302 is subsequently detected by the second sensor 312.

Further, the CPU 701 detects the belt mark detection times in advance and calculates a time difference therebetween in advance, and sets the calculated value as $T2_{base}$ representing a reference value of T2. The CPU 701 also sets, as $T2_{now}$, a result of the above-mentioned measurement of T2 performed at the timing of correction. When the belt length exhibited at the time of measuring $T2_{base}$ is different from the belt length exhibited at the time of measuring $T2_{now}$, $T2_{now}$ and $T2_{base}$ have different values. In addition, a change in belt length can be obtained from $T2_{now}$ and $T2_{base}$. In at least one embodiment, the belt length exhibited when the value of T2 is $T2_{base}$ and the leading edge registration position exhibited in that case are set as references, and the leading edge registration position change amount $R_{offset}$ is obtained. It is noted that $R_{offset}$ is an amount of change from the leading edge registration position, which is used as the reference. In at least one embodiment, the calculation expression for a change in leading edge registration position is used to obtain the leading edge registration position change amount $R_{offset}$ from a difference between $T2_{base}$ and $T2_{now}$ and a belt conveying speed derived earlier.

In at least one embodiment, a specific calculation expression for the leading edge registration position change amount $R_{offset}$ can be determined as follows using $T2_{base}$, $T2_{now}$, the belt conveying speed $V_{base}$ being the reference, the belt conveying speed change amount $V_{offset}$, and a correction amount H based on the belt conveying speed change.

$$R_{offset}=(T2_{now}-T2_{base})*(V_{base}+V_{offset})+H \quad \text{(Expression 4)}$$

$$H=V_{now}\{(L1_{now}+L2_{new})/V_{now}-(L1_{base}+L2_{base})/V_{base}\} \quad \text{(Expression 5)}$$

where L1 represents a conveyance distance from the primary transfer position for the reference color to the first sensor 311, and L2 represents a conveyance distance from the second sensor 312 to the secondary transfer position. $L1_{base}$, $L2_{base}$, $L1_{now}$, and $L2_{now}$ are L1 and L2 in the reference state and L1 and L2 at the timing of performing correction, respectively.

In Expression 4, $(T2_{now}-T2_{base})*(V_{base}+V_{offset})$ represents the amount of change in belt length. Therefore, the sum of the belt length at the time of measuring $T2_{base}$ and $(T2_{now}-T2_{base})*(V_{base}+V_{offset})$ represents the belt length at the time of measuring $T2_{now}$. In addition, an influence on the leading edge registration position ascribable to the change in belt conveying speed obtained by measuring $T1_{now}$ is reflected through use of the correction amount H.

Figure 4:
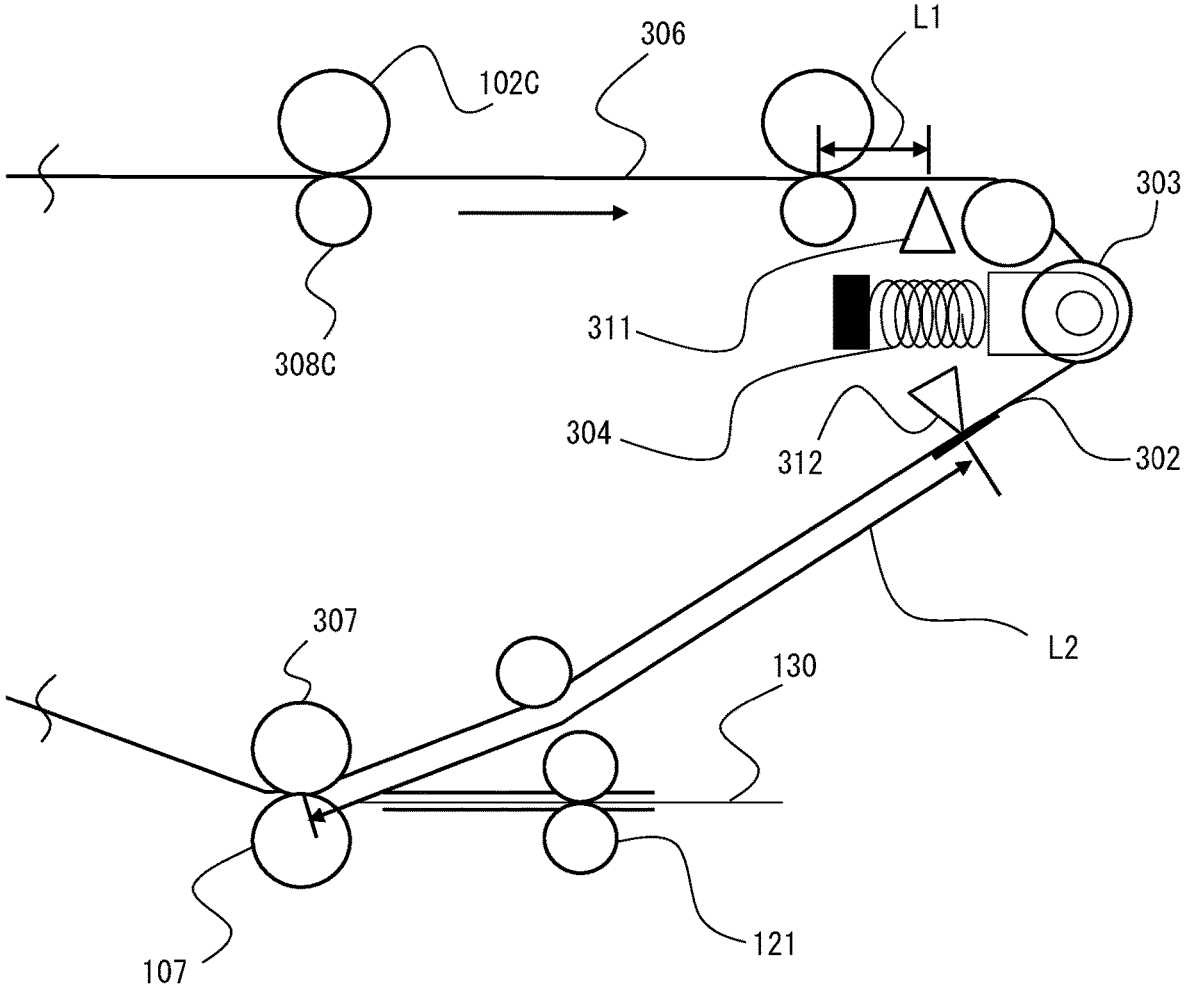
FIG. 4 is an enlarged view of the image forming unit.

In FIG. 4, an enlarged view of the image forming unit is illustrated in order to describe L1 and L2. As illustrated in FIG. 4, the reference color is black (k), and a conveyance distance between the primary transfer position determined by the photosensitive drum 102*k* and the first sensor 311 is L1. Meanwhile, a conveyance distance between the second sensor 312 and the secondary transfer position determined by the secondary transfer inner roller 307 is L2.

In addition, under a continuous operation state, the temperature of the intermediate transfer unit 300 is substantially uniform due to air stirring effect caused by driving the belt. That is, the temperature of the drive roller 305 and the temperature of the secondary transfer frame are considered to be substantially the same. The material of the secondary transfer frame configured to support the primary transfer portion, the first sensor 311, the second sensor 312, and the secondary transfer portion is steel. From this fact, assuming that a temperature increase from a temperature exhibited under the reference state to a temperature exhibited at the timing of performing correction is represented by ΔT, $L1_{base}$ and $L2_{base}$ can be defined as follows using a linear expansion coefficient α_steel of steel.

$$L1_{now}=L1_{base}*(\alpha_\text{steel}\Delta T+1) \quad \text{(Expression 6)}$$

$$L2_{now}=L2_{base}*(\alpha_steel\Delta T+1) \quad \text{(Expression 7)}$$

The material of the drive roller 305 is aluminum, and hence $V_{now}$ can be defined as follows using the linear expansion coefficient α_aluminum of aluminum.

$$V_{now}=V_{base}+V_{offset}=V_{base}*(\alpha_aluminum\Delta T+1) \quad \text{(Expression 8)}$$

Those expressions are summarized as follows.

$$H=(L1_{base}+L2_{base})\{(\alpha_steel/\alpha_aluminum-1)*(V_{offset}/V_{base})\} \quad \text{(Expression 9)}$$

However, the drive roller 305 has the base material made of aluminum and is provided with the rubber layer on its surface, and the secondary transfer frame has the base material made of iron with the resin material, the resin material is used for the holding portion for a sensor. The actual value of α_aluminum/α_steel is different from the value obtained by the above-mentioned simple theoretical expression, and hence α_aluminum/α_steel may be replaced by k2 to actually measure the value of k2 in advance and store the value of k2 as a constant in, for example, the storage unit 705.

The CPU 701 calculates the sub-scanning magnification change amount $S_{offset}$ and the leading edge registration position change amount $R_{offset}$ from times at which the belt mark 302 passes through the first sensor 311 and the second sensor 312 based on the principle described above. The CPU 701 controls the light scanning device 200 based on those calculated values, and corrects the sub-scanning magnification and the leading edge registration position. At this time, the leading edge registration position may be corrected by controlling the drive timing of the drive roller 305.

Secondary Transfer Characteristic Change Calculation Flow

Figure 5:
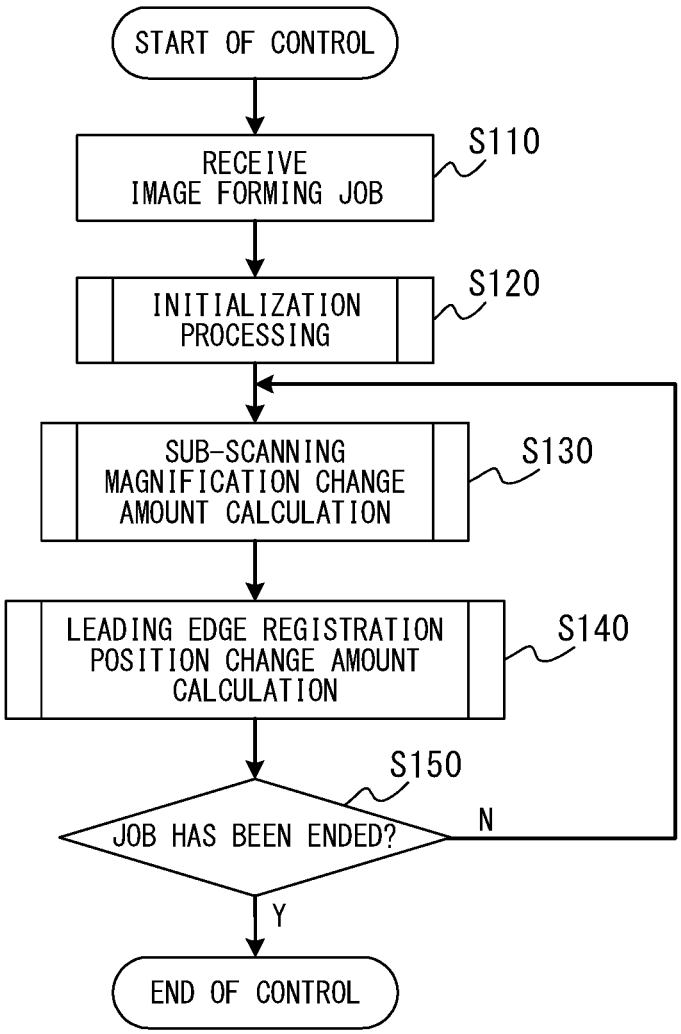
FIG. 5 is a flow chart for illustrating processing for calculating a change amount of a sub-scanning magnification and a change amount of a leading edge registration position.
Figure 6A:
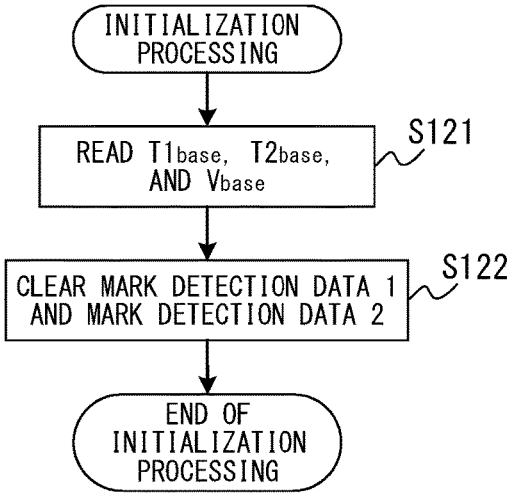
FIG. 6A, FIG. 6B, and FIG. 6C are flow charts for illustrating details of the processing for calculating the change amount of the sub-scanning magnification and the change amount of the leading edge registration position.
Figure 6C:
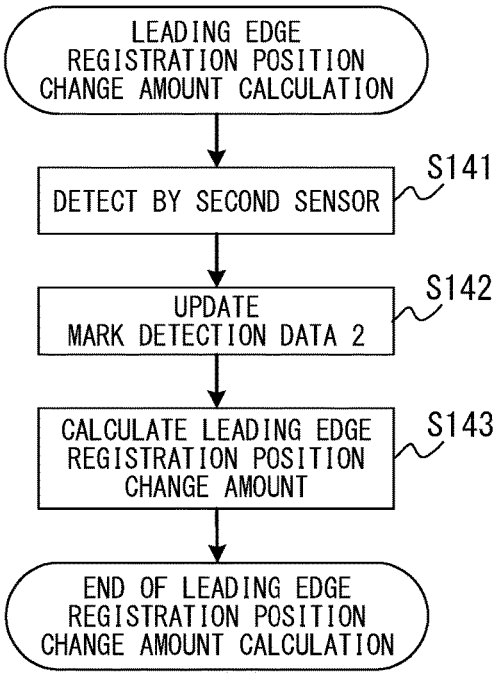
Figure 6B:
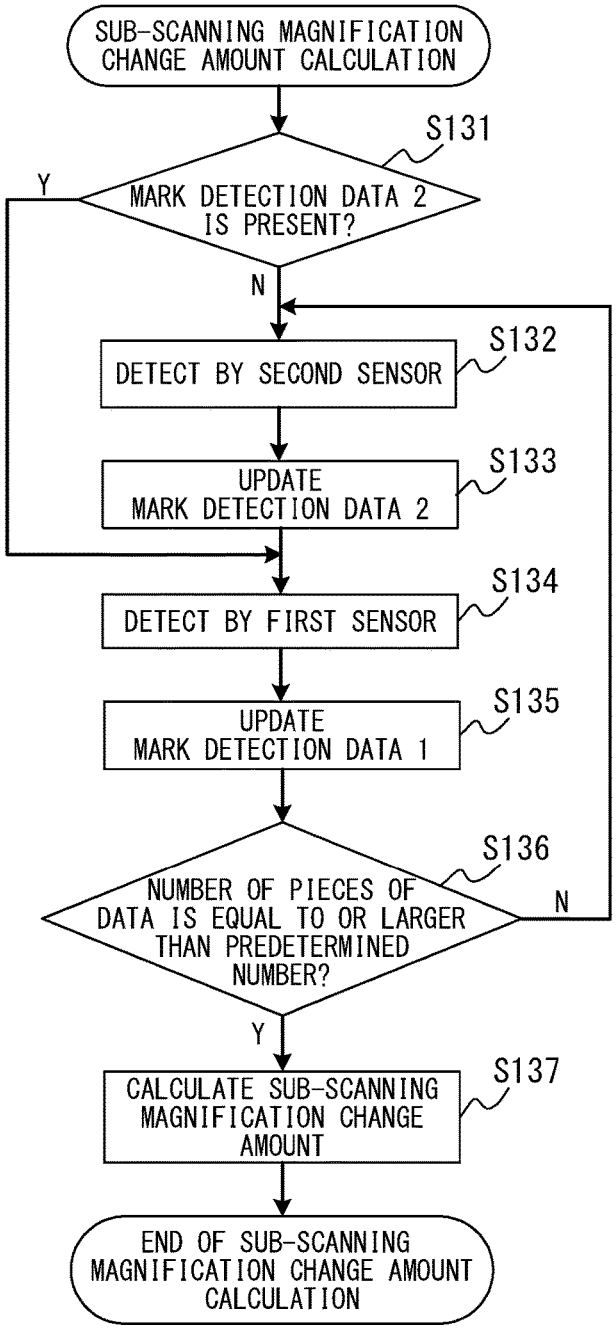

In the following, a flow of calculating the amounts of change in sub-scanning magnification and leading edge registration position in the intermediate transfer unit 300 in at least one embodiment is described. FIG. 5 is a flow chart for illustrating processing from the start of a job to the calculation of the amounts of change in sub-scanning magnification and leading edge registration position, and FIG. 6A to FIG. 6C are flow charts for illustrating details of the processing illustrated in the flow chart of FIG. 5.

Referring to FIG. 5, the CPU 701 receives an image forming job (Step S110), and executes initialization processing (Step S120). Details of the initialization processing Step S120 are described later with reference to FIG. 6A. After executing the initialization processing of Step S120, the CPU 701 calculates the belt conveying speed change amount $V_{offset}$ from $T1_{now}$, which is described above, for the image forming job, and then calculates the sub-scanning magnification change amount $S_{offset}$ (Step S130). Details thereof are described later with reference to FIG. 6B.

After that, the CPU 701 uses the mark detection data 1 and the mark detection data 2, which are obtained in the calculation of the sub-scanning magnification change amount of Step S130, to execute the calculation of the leading edge registration position change amount (Step S140). Details of the calculation of the leading edge registration position change amount are described later with reference to FIG. 6C. After executing Step S140, the CPU 701 determines whether or not the image forming job has been ended (Step S150). When the image forming job has not been ended, the CPU 701 again executes Step S130. When the image forming job has been ended, the CPU 701 brings the processing to an end.

Next, details of the initialization processing Step S120 are described with reference to FIG. 6A. The CPU 701 acquires data to be used as references for changes, namely, $T1_{base}$, $T2_{base}$, and $V_{base}$, which are described above, from the storage unit 705 (Step S121). After that, the CPU 701 clears the mark detection data 1 and the mark detection data 2 stored in the RAM 703 (Step S122).

With reference to FIG. 6B, details of the processing for calculating the sub-scanning magnification change amount in Step S130 are described. The CPU 701 determines whether or not the mark detection data 2 obtained by the second sensor 312 is present immediately after the start of the job (Step S131). When determining that there is no mark detection data 2 (N in Step S131), the CPU 701 detects the belt mark 302 by the second sensor (Step S132), updates the mark detection data 2 (Step S133), and advances the processing to Step S134, which is described later. When determining in Step S131 that the mark detection data 2 is present (Y in Step S131), the CPU 701 also advances the processing to Step S134.

After that, the CPU 701 detects the belt mark 302 by the first sensor 311 (Step S134), and updates the mark detection data 1 (Step S135). In this case, $T1_{now}$ includes a detection error, and hence the CPU 701 determines whether or not at least a predetermined number of pieces of data required for taking a moving average have been obtained (Step S136). When the number of pieces of data is smaller than the predetermined number (N in Step S136), the CPU 701 again executes Step S132, and repeatedly acquires the mark detection data 1 and the mark detection data 2. When the number of pieces of data that have been obtained is equal to or larger than the predetermined number (Y in Step S136), the CPU 701 takes the moving average of the pieces of data (Step S137).

After acquiring the predetermined number of pieces of data, the CPU 701 calculates $T1_{now}$ to calculate the above-mentioned sub-scanning magnification change amount $S_{offset}$ (Step S137). After that, the CPU 701 controls the light scanning device 200 so as to cancel the calculated sub-scanning magnification change amount $S_{offset}$ with respect to the sheet 130. Next, a detailed description is given of the calculation of the leading edge registration position change amount, which is executed while taking over the mark detection data 1 and the mark detection data 2 acquired in the calculation of the sub-scanning magnification change amount in Step S140 of FIG. 5. The CPU 701 detects the passage of the belt mark 302 by the second sensor 312 (Step S141), and updates the mark detection data 2 (Step S142). The CPU 701 also calculates $T2_{now}$ by taking the moving average to calculate the leading edge registration position change amount $R_{offset}$ in the above-mentioned manner (Step S143).

The CPU 701 controls the light scanning device 200 so as to cancel the calculated leading edge registration position change amount $R_{offset}$ with respect to the subsequent sheets 130. Instead of canceling the leading edge registration position change amount $R_{offset}$ by controlling the light scanning device 200, the leading edge registration position change amount $R_{offset}$ may be canceled by controlling the conveyance driving device 122.

In accordance with the above-mentioned flow, the CPU 701 obtains the change in sub-scanning magnification, corrects the sub-scanning magnification by controlling the light scanning device 200, and then detects the leading edge registration position change amount to control the light scanning device 200 or the conveyance driving device 122. After the image forming job is executed for a long period of time, the state of the intermediate transfer unit 300 changes due to the temperature increase of the image forming apparatus. However, according to at least one embodiment, by correcting the deviation of the leading edge registration position, it is possible to stably maintain the same sub-scanning magnification and the same leading edge registration position as those in the reference state.

As described above, according to at least one embodiment, a desired image can be obtained with high accuracy by performing the detection of a variation in belt conveying speed and a variation in belt length detection, which exert an influence on each other, through use of the same simple detection system. In addition, through use of the same detection system, it is possible to simplify the configuration for forming a desired image, and to reduce the cost.

As described above, according to at least one embodiment of the present disclosure, there is provided an image forming apparatus capable of forming a desired image with high accuracy.

The present disclosure is not limited to at least one embodiment described above, and can be implemented in various forms. For example, the material of the drive roller 305 is not limited to aluminum, and any material can be used. Further, in Expression 1, $V_{offset}$ is obtained using $T1_{base}$ and $T1_{now}$, but $T1_{now}$ may be measured a plurality of times, and $V_{offset}$ may be obtained using the average value or median value of the measured $T1_{now}$ and $T1_{base}$.

Similarly, in Expression 4, $R_{offset}$ is obtained using $T2_{base}$ and $T2_{now}$, but $T2_{now}$ may be measured a plurality of times, and $R_{offset}$ may be obtained using the average value or median value of the measured $T2_{now}$ and $T2_{base}$.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-012066, filed Jan. 28, 2019, which is hereby incorporated by reference herein in its entirety.

What is claimed is:

1. An image forming apparatus, comprising:

an intermediate transfer unit including:

an endless belt configured to convey a sheet on which an image is to be formed;

a conveying roller configured to convey the endless belt while being driven by a drive source;

a first detecting unit configured to detect a specific position on the endless belt;

a second detecting unit configured to detect the specific position on the endless belt;

a tension roller, which is provided between the first detecting unit and the second detecting unit, and is configured to support the endless belt in a tensioned state while applying a tensile force to the endless belt; and a control unit, wherein the control unit is configured to:

obtain a first measurement time and a second measurement time, the first measurement time representing, based on detection results obtained by the first detecting unit and the second detecting unit, a time period elapsed after the specific position is detected by the second detecting unit until the specific position is detected by the first detecting unit without passing the tension roller, and the second measurement time representing a time period elapsed after the specific position is detected by the first detecting unit and passes the tension roller until the specific position is detected by the second detecting unit;

obtain a conveying speed of the endless belt based on the first measurement time;

obtain a change in belt length of the endless belt due to the tensile force of the tension roller, based on the second measurement time; and perform image formation based on the obtained conveying speed and the obtained change in belt length.

2. The image forming apparatus according to claim 1, wherein the control unit is configured to obtain an amount of change in the conveying speed of the endless belt based on a reference value of the first measurement time and a measurement result of the first measurement time.

3. The image forming apparatus according to claim 2, wherein the control unit is configured to obtain the amount of change in the conveying speed of the endless belt by setting, as a reference, the conveying speed of the endless belt corresponding to the reference value of the first measurement time.

4. The image forming apparatus according to claim 3, wherein the drive source comprises a drive roller, and wherein the control unit is configured to correct the amount of change in the conveying speed of the endless belt based on a thermal expansion coefficient of the drive roller by setting, as a reference, the conveying speed of the endless belt corresponding to the reference value of the first measurement time.

5. The image forming apparatus according to claim 2, wherein the control unit is configured to obtain a sub-scanning magnification change amount exhibited during image formation from the amount of change in the conveying speed of the endless belt and the conveying speed of the endless belt corresponding to the reference value of the first measurement time, and perform the image formation based on the obtained sub-scanning magnification change amount.

6. The image forming apparatus according to claim 2, further comprising a storage unit configured to store the reference value of the first measurement time, wherein the control unit is configured to obtain the conveying speed based on the reference value of the first measurement time read from the storage unit and on the measurement result of the first measurement time.

7. The image forming apparatus according to claim 1, wherein the control unit is configured to obtain a change in belt length of the endless belt through use of a reference value of the second measurement time and a measurement result of the second measurement time.

8. The image forming apparatus according to claim 7, wherein the control unit is configured to obtain a change amount of the image formation position by setting, as a reference, an image formation position with respect to the sheet corresponding to the reference value of the second measurement time.

9. The image forming apparatus according to claim 1, further comprising a storage unit configured to store a reference value of the second measurement time, wherein the control unit is configured to obtain a change in belt length of the endless belt through use of the reference value of the second measurement time read from the storage unit and a measurement result of the second measurement time.

10. The image forming apparatus according to claim 1, wherein the endless belt is configured to be conveyed from the first detecting unit past the tension roller to the second detecting unit by a first distance shorter than a second distance, wherein the second distance is a distance by which the endless belt is to be conveyed from the second detecting unit to the first detecting unit without passing the tension roller.

11. The image forming apparatus according to claim 10, wherein at least one of the first distance and the second distance is set to an integral multiple of a circumferential length of the conveying roller.

* * * * *